US008156589B2

(12) United States Patent
Liu et al.

(10) Patent No.: US 8,156,589 B2
(45) Date of Patent: Apr. 17, 2012

(54) AIR MATTRESS

(75) Inventors: Tsung-Hsi Liu, Taipei (TW); Tsung-Hsuan Liu, Taipei (TW)

(73) Assignee: Caremed Supply, Inc., New Taipei (TW)

( * ) Notice: Subject to any disclaimer, the term of this patent is extended or adjusted under 35 U.S.C. 154(b) by 471 days.

(21) Appl. No.: 12/561,272

(22) Filed: Sep. 17, 2009

(65) Prior Publication Data

US 2011/0061169 A1 Mar. 17, 2011

(51) Int. Cl.
*A47C 27/10* (2006.01)

(52) U.S. Cl. ..... 5/713; 5/710; 5/655.3

(58) Field of Classification Search ..... 5/706, 710, 5/713, 715, 655.3; 297/284.6
See application file for complete search history.

(56) References Cited

U.S. PATENT DOCUMENTS

| | | | | |
|---|---|---|---|---|
| 4,949,412 | A | 8/1990 | Goode | |
| 5,035,016 | A * | 7/1991 | Mori et al. | 5/713 |
| 5,073,999 | A | 12/1991 | Thomas et al. | |
| 5,152,319 | A * | 10/1992 | Hannagan et al. | 137/624.18 |
| 5,243,721 | A * | 9/1993 | Teasdale | 5/710 |
| 5,920,934 | A * | 7/1999 | Hannagan et al. | 5/713 |
| 6,253,402 | B1 * | 7/2001 | Lin | 5/713 |
| 6,266,833 | B1 * | 7/2001 | Lin | 5/713 |
| 6,782,574 | B2 * | 8/2004 | Totton et al. | 5/713 |
| 6,813,790 | B2 * | 11/2004 | Flick et al. | 5/713 |
| 7,028,358 | B2 * | 4/2006 | Liu | 5/710 |
| 7,036,171 | B2 * | 5/2006 | Wu | 5/713 |
| 7,717,134 | B2 * | 5/2010 | Chang | 137/861 |
| 7,784,132 | B2 * | 8/2010 | Gonzalez et al. | 5/713 |
| 7,966,680 | B2 * | 6/2011 | Romano et al. | 5/713 |
| 2006/0179579 | A1 | 8/2006 | Phillips et al. | |

FOREIGN PATENT DOCUMENTS

EP 0606126 A2 7/1994

* cited by examiner

*Primary Examiner* — Michael Trettel
(74) *Attorney, Agent, or Firm* — CKC & Partners Co., Ltd.

(57) ABSTRACT

Disclosed herein is an air mattress including at least two separate zones. A first and second groups of elongate, inflatable cells are disposed alternately within each of the at least two separate zones. An air pump is to supply pressurized air. At least two air distributors are serially connected with the air pump for respectively distributing the pressurized air to the at least two separate zones. Each air distributor is operable to supply the pressurized air to the first and second groups of cells within each of the at least two separate zones. A pressure reducer is serially connected between any adjacent two of the at least two distributors for reducing the pressure of the pressurized air to a downstream one of any adjacent two of the at least two distributors.

17 Claims, 9 Drawing Sheets

AIR MATTRESS

BACKGROUND

1. Field of Invention

The present invention relates to an air mattress with air pressure control.

2. Description of Related Art

Air mattresses are used with cots and beds to provide yieldable body support. The air mattresses are inflated with pumps, such as hand operated or bag pumps. Motor driven blowers and pumps have also been to supply air under pressure to air mattresses. The biasing or firmness characteristics of an air mattress is determined by the pressure of the air in the air mattresses. The air mattress firmness can be varied by supplying additional air or venting air from the air mattress. Control mechanisms have been used to adjust the inflation of the air mattress. Even better control mechanisms applied to the air mattresses are necessary when the air mattresses are designed for a patient who is confined on the air mattresses for an extended period of time.

SUMMARY

In one aspect of this invention, an air mattress includes at least two separate zones. A first and second groups of elongate, inflatable cells are disposed alternately within each of the at least two separate zones. An air pump is to supply pressurized air. At least two air distributors are serially connected with the air pump for respectively distributing the pressurized air to the at least two separate zones. Each air distributor is operable to supply the pressurized air to the first and second groups of cells within each of the at least two separate zones. A pressure reducer is serially connected between any adjacent two of the at least two distributors for reducing the pressure of the pressurized air to a downstream one of any adjacent two of the at least two distributors.

Thus, the air pump is serially connected with several air pressure control devices to control multiple zones of an air mattress so as to reduce necessary air pressure control devices.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
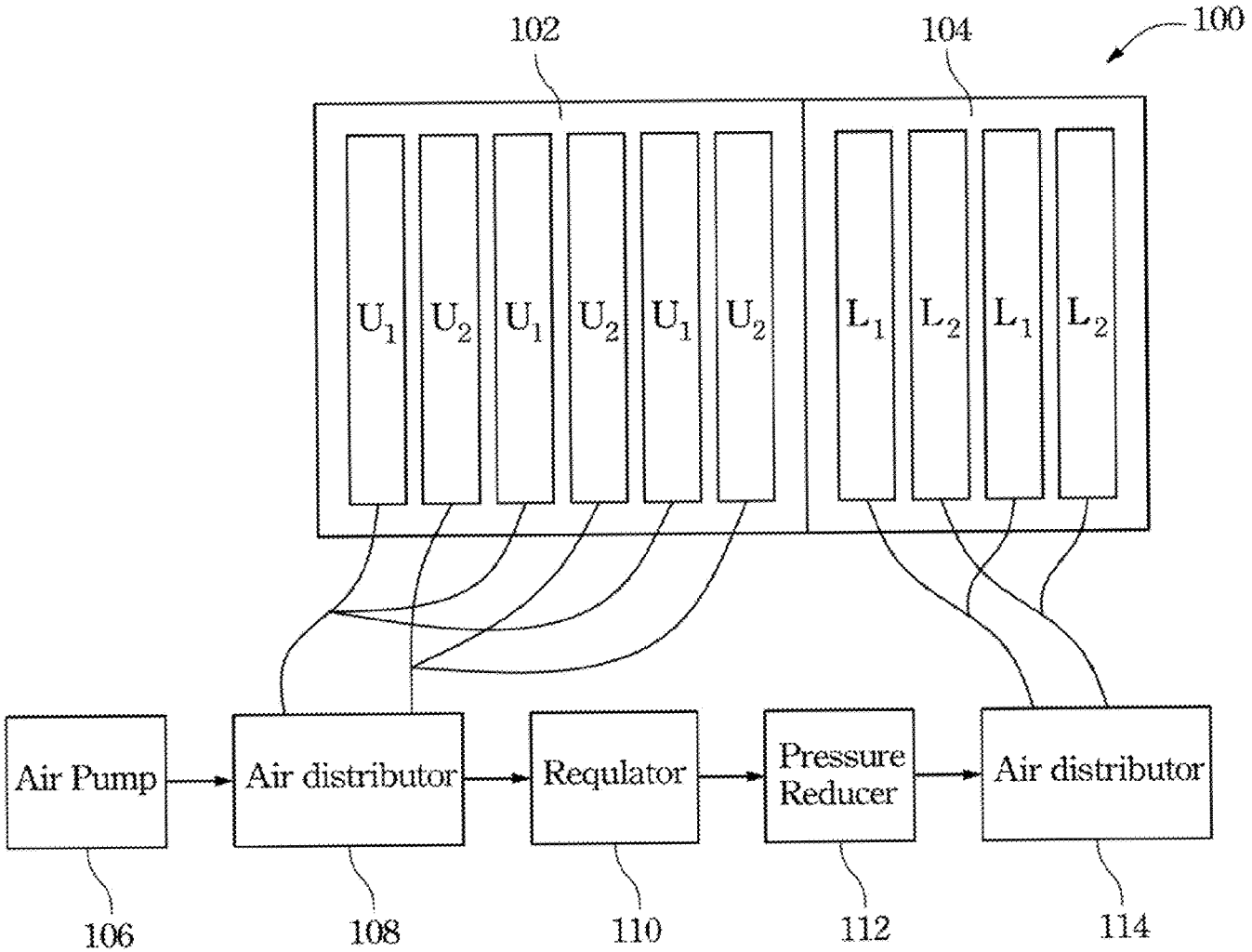
FIG. 1 illustrates a block diagram of an air mattress with air pressure control according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

FIG. 1 illustrates a block diagram of an air mattress with air pressure control according to one embodiment of this invention. The air mattress 100 with air pressure control includes two separate zones (102 and 104) or more, within each zone of which a first and second groups of elongate, inflatable cells, e.g. cells $U_1$ and cells $U_2$ in the zone 102 or cells $L_1$ and cells $L_2$ in the zone 104, are alternately arranged. The zone 102 may be designed for supporting a patent's upper body while the zone 104 may be designed for supporting a patent's lower body. The air mattress firmness of the zone 104 may be lower than that of the zone 102 such that the patent's lower body, e.g. legs or feet can be of comfortable support. An air pump 106 supplies pressurized air to the air mattress 100 and the pressure of the air in the air mattress is varied by various air pressure control devices, i.e. 108, 110, 112 and 114, illustrated in the drawings. In particular, two air distributors (108, 114) are serially connected with the air pump 106 for respectively distributing the pressurized air to the two separate zones (102, 104). Each air distributor (108 or 114) is operable to supply the pressurized air to the first and second groups of cells ($U_1$ and $U_2$ or $L_1$ and $L_2$) within each of the at least two separate zones. If the air mattress is divided into three or more zones, three or more distributors are needed to control respective zones. A pressure reducer 112 is serially connected between two distributors (108, 114) for reducing the pressure of the pressurized air to the downstream distributor 114. If there are three or more distributors, a pressure reducer is serially connected between any adjacent two of the three or more distributors for reducing the pressure of the pressurized air to a downstream one of any adjacent two distributors. A regulator 110 may be serially connected between the pressure reducer 112 and the upstream air distributor 108. If there are three or more distributors, a regulator is serially connected between the pressure reducer and an upstream one of any adjacent two of the three or more distributors.

Figure 2:
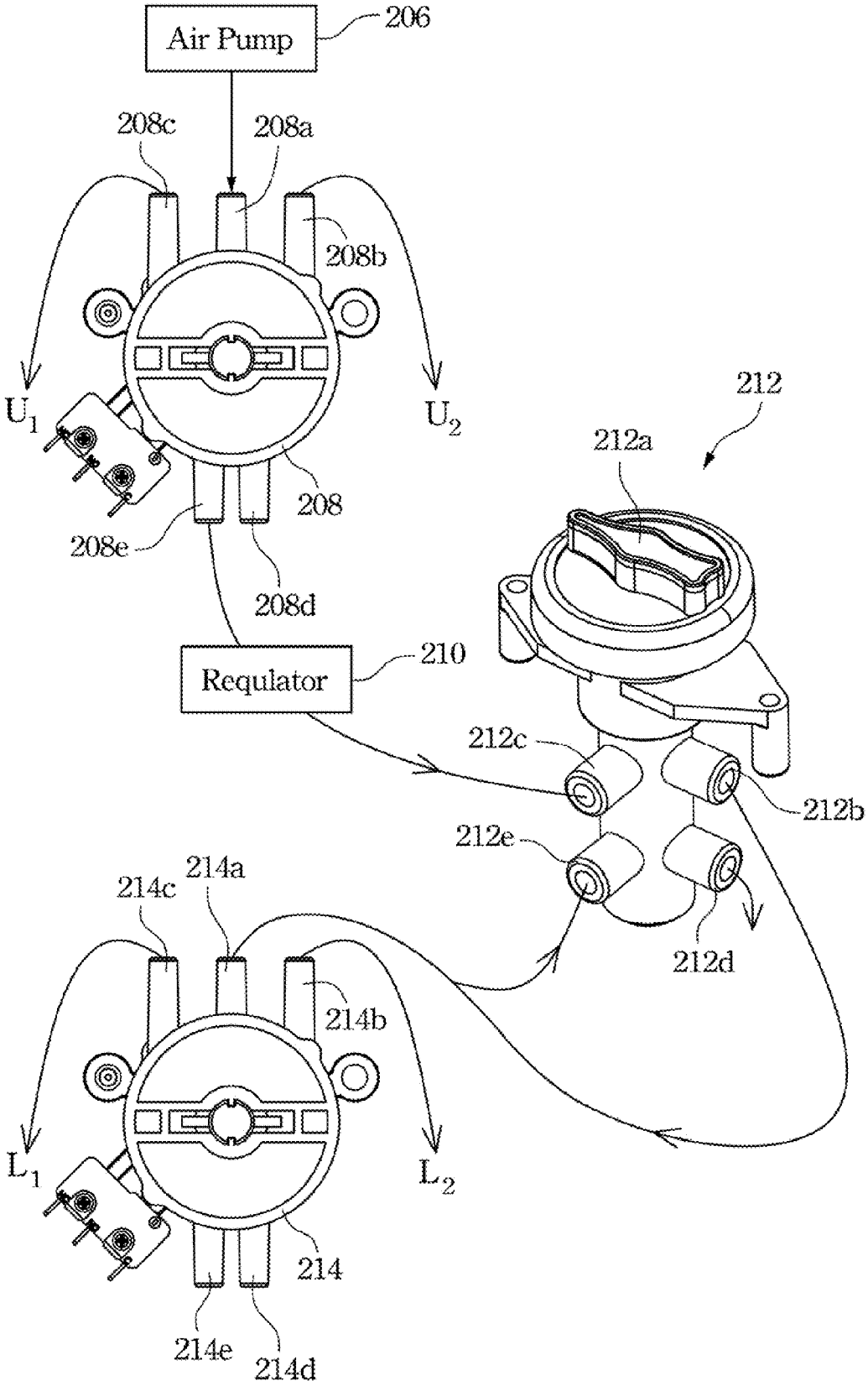
FIG. 2 illustrates a diagram of an air pump set for an air mattress according to another embodiment of this invention.

FIG. 2 illustrates a diagram of an air pump set for an air mattress according to another embodiment of this invention. An air pump 206 is to supply pressurized air. Two air distributors (208, 214) are serially connected with the air pump 206. A pressure reducer 212 is serially connected between two air distributors (208, 214) for reducing the pressure of the pressurized air to the downstream distributor 214. A regulator 210 may be serially connected between the pressure reducer 212 and the upstream air distributor 208.

The air distributor 208 has an inlet and four outlets. The inlet 208*a* of the air distributor 208 is connected to the air pump 206 to receive the pressurized air. Two outlets (208*b*, 208*c*) are to distribute the pressurized air to respective air-requiring targets, e.g. inflatable cells $U_1$ and $U_2$ in FIG. 1. An outlet 208*e* is connected to the regulator 210 or directly to the pressure reducer 212 (if the regulator 210 is not installed). An outlet 208*d* is to vent air out. The air distributor's operation mechanisms are illustrated and articulated in the embodiments of FIG. 4A through FIG. 4D.

The pressure reducer 212 has two pairs of inlets and outlets, i.e. inlet 212*c*, outlet 212*b*, inlet 212*e* and outlet 212*d*. A user may turn a knob 212*a* to switch the pressure reducer 212 between two pressure reducing ratios. The inlet 212*c* of the pressure reducer 212 is connected to the outlet 208*e* of the air distributor 208 (if the regulator 210 is not installed) or the regulator 210 whereas the outlet 212*b* of the pressure reducer 212 is connected to the downstream air distributor 214. The inlet 212*e* of the pressure reducer 212 is also connected to the downstream air distributor 214. The outlet 212*d* is to vent air out. The pressure reducer's detailed structures are illustrated and articulated in the embodiment of FIG. 5, and its operation mechanisms are illustrated and articulated in the embodiments of FIG. 5A and FIG. 5B.

The air distributor 214 has an inlet and four outlets. The inlet 214*a* of the air distributor 214 is connected to both the inlet 212*e* and outlet 212*b* of the pressure reducer 212. Two outlets (214*b*, 214*c*) are to distribute the pressurized air to respective air-requiring targets, e.g. inflatable cells $L_1$ and $L_2$ in FIG. 1. An outlet 214*e* is connected to a further air distributor or pressure reducer (if necessary), otherwise the outlet 214*e* may be sealed. An outlet 214*d* is to vent air out. The air distributor's operation mechanisms are illustrated and articulated in the embodiments of FIG. 4A through FIG. 4D.

The regulator 210 may be serially connected between the pressure reducer 212 and the upstream air distributor 208 to regulate down the pressure of all the pressurized air (supplied by the air pump 206) upstream the pressure reducer 212.

Figure 3:
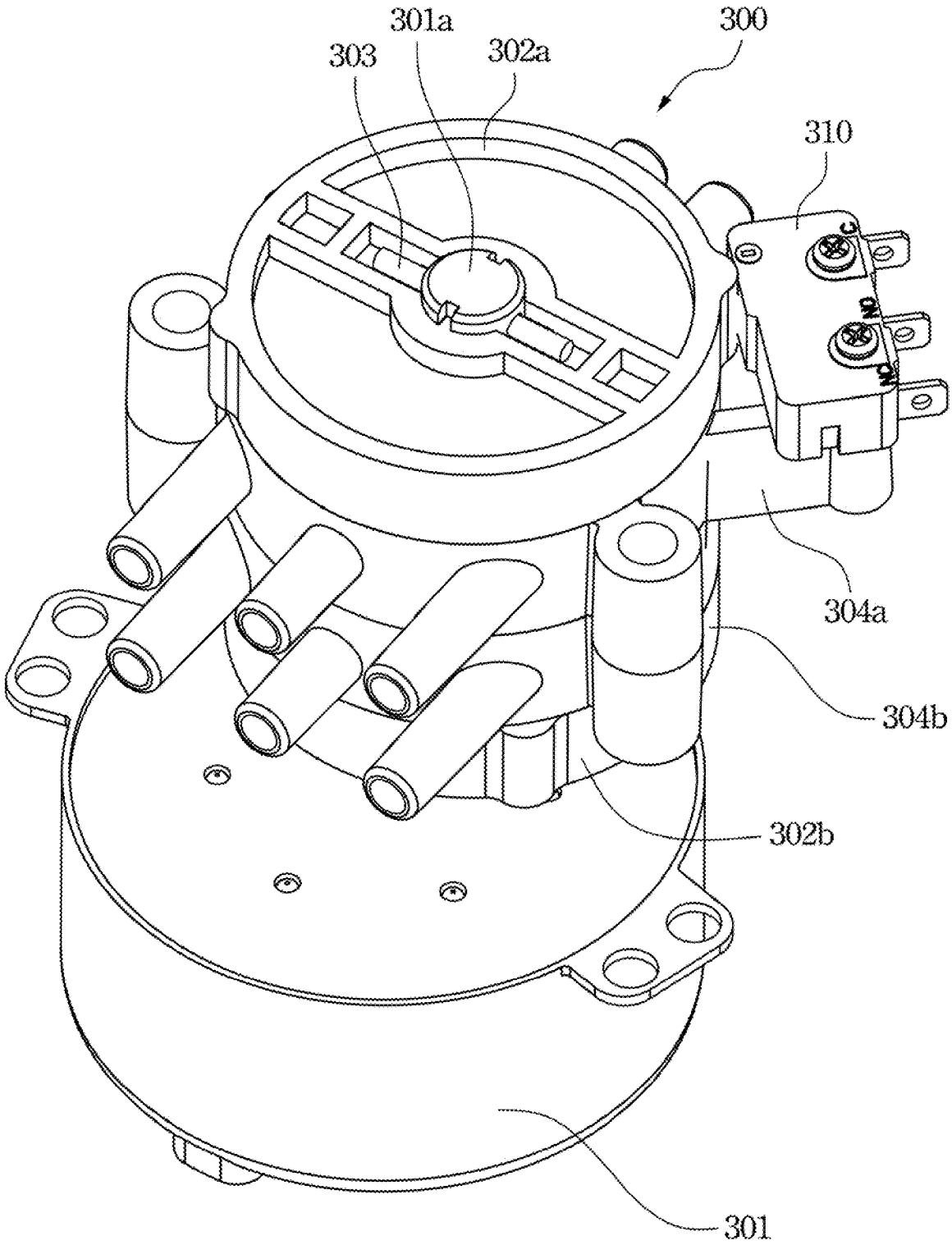
FIG. 3 illustrates an air distributor module of the air mattress according to another embodiment of this invention.
Figure 3A:
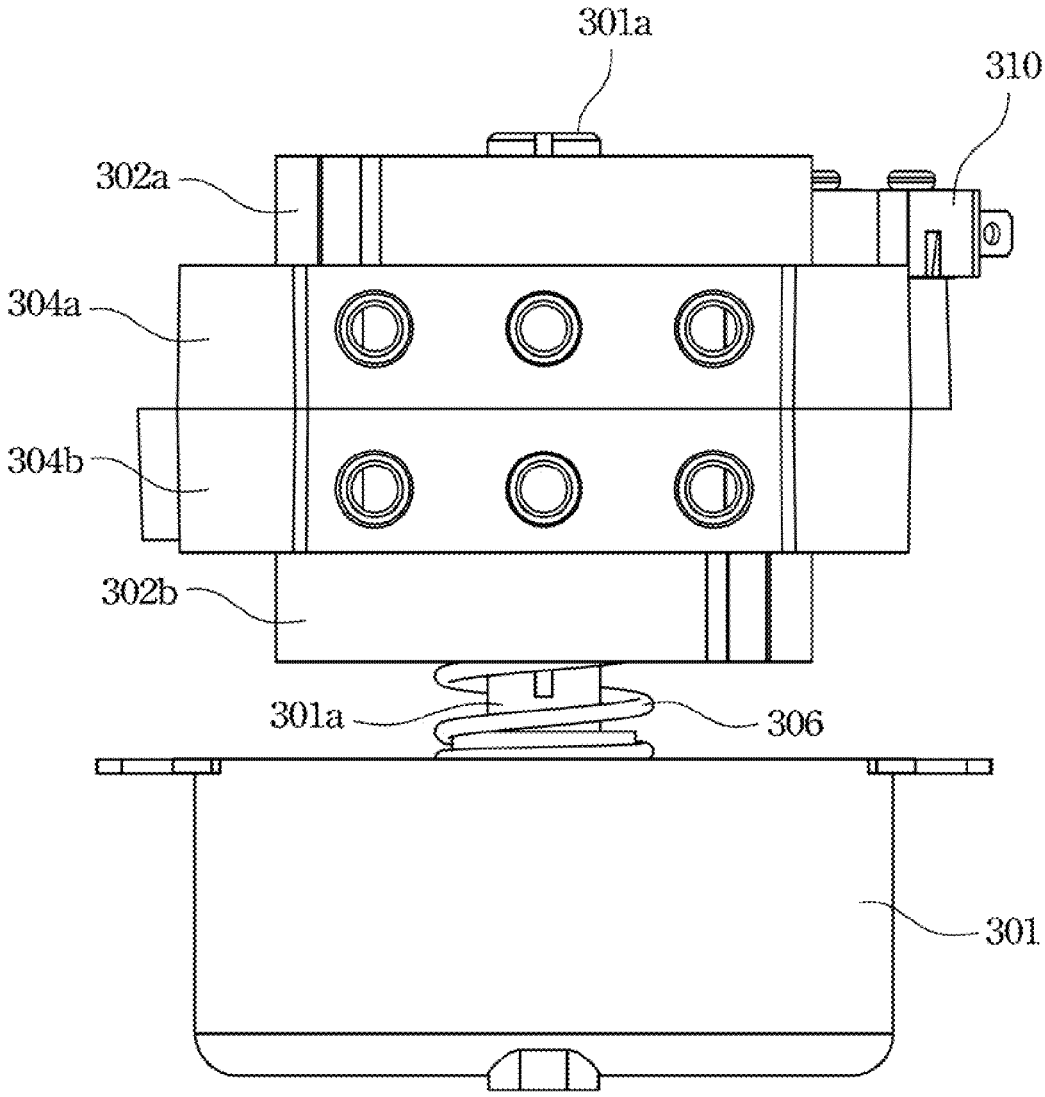
FIG. 3A illustrates a side view of the air distributor module in FIG. 3.

FIG. 3 illustrates an air distributor module of the air mattress according to another embodiment of this invention, and FIG. 3A illustrates a side view of the air distributor module in FIG. 3. The air distributor module 300 basically consists of two air distributors combined. Each air distributor consists of two disc-shaped halves, e.g. disc-shaped halves (302*a*, 304*a*) or disc-shaped halves (302*b*, 304*b*), rotatably interconnected with each other to form chambers therebetween for distributing air out through various outlets thereof. A rotatable shaft 301*a* is inserted through all the disc-shaped halves and driven by a motor 301. Rotatable disc-shaped halves (302*a*, 302*b*) are secured to the shaft 301*a*, e.g. using a pin 303 penetrating the shaft 301*a* such that the disc-shaped halves (302*a*, 302*b*) can be rotated simultaneously with the shaft 301*a*. Static disc-shaped halves (304*a*, 304*b*) are equipped with all inlets and outlets, and do not rotate relative to the motor 301, i.e. the static disc-shaped halves (304*a*, 304*b*) are not secured to the shaft 301*a*. A compression spring 306 is arranged between the disc-shaped half 302*b* and the motor 301 (and around the shaft 301*a*) to press the four disc-shaped halves together. Each interface between any adjacent two disc-shaped halves may be lubricated by a friction-reducing substance, for example, silicone so as to smoothen the rotating of disc-shaped halves (302*a*, 302*b*) as well as to keep each interface airtight sealed.

The advantages of combining two air distributors includes at least the following:

(1) Only one motor 301 and one controller 310 (or timer) are necessary to control two air distributors, instead of one motor and one controller being conventionally used to control one air distributor; and (2) Disc-shaped halves (302*a*, 302*b*) can be easily controlled to rotate simultaneously because both of them are secured to the same shaft 301*a*.

FIG. 4A-FIG. 4D respectively illustrate four operation modes of the air distributor module in FIG. 3. It should be noted that each Figure illustrates single one air distributor, i.e. two disc-shaped halves (302*a*, 304*a*). The rotatable disc-shaped half 302*a* is labeled with $T_1$ and $T_2$ to clearly indicate its orientation in four Figures. The chamber layout between two disc-shaped halves is roughly illustrated in dashed-lines.

Figure 4A:
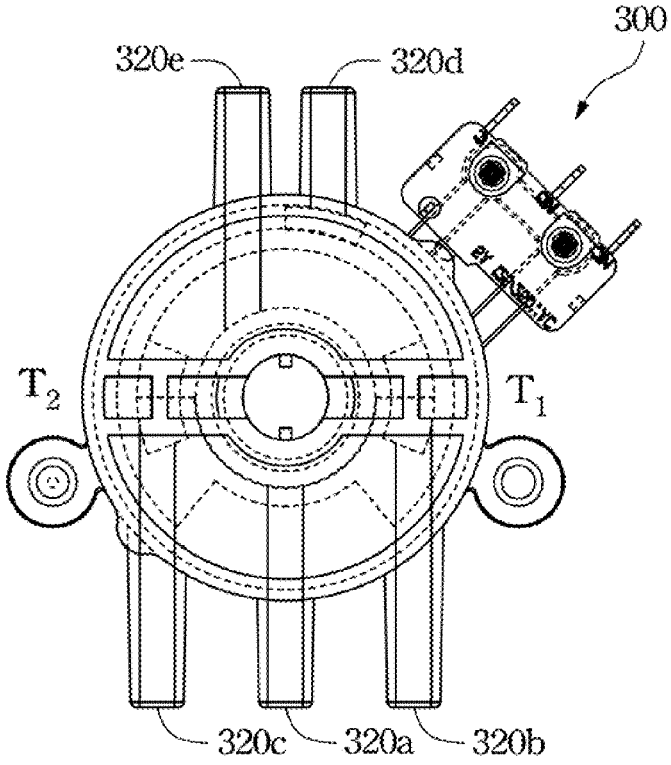
FIG. 4A-FIG. 4D respectively illustrate four operation modes of the air distributor module in FIG. 3.

In FIG. 4A, the disc-shaped half 302*a* is at the position with $T_1$ at a right-hand side and $T_2$ at a left-hand side. In this operation mode, an inlet 320*a* and three outlets (320*b*, 320*c*, 320*e*) are gas-interconnected, i.e. gas can be transferred through, to one another. That is, the pressurized air can be input through an inlet 320*a* and output through outlets (320*b*, 320*c*, 320*e*). The outlet 320*e* is connected to a regulator, a pressure reducer or another downstream air distributor. In this operation mode, an outlet 320*d*, which is to vent air out, is not gas-interconnected to the inlet 320*a* or three outlets (320*b*, 320*c*, 320*e*).

Figure 4B:
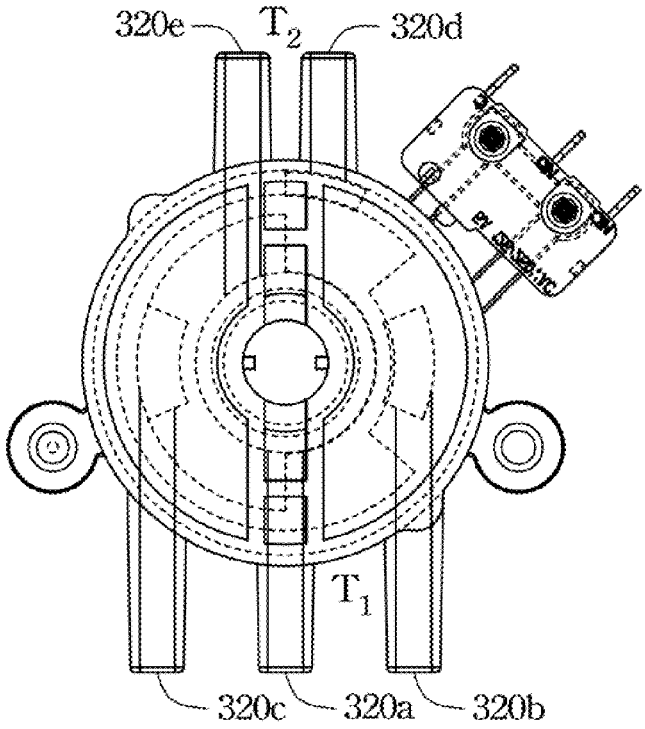

In FIG. 4B, the disc-shaped half 302*a* is at the position with $T_1$ at a lower side and $T_2$ at an upper side. In this operation mode, an inlet 320*a* and two outlets (320*c*, 320*e*) are gas-interconnected to one another whereas the two outlets (320*h*, 320*d*) are gas-interconnected to each other. That is, the pressurized air can be input through an inlet 320*a* and output through outlets (320*c*, 320*e*). The outlet 320*e* is connected to a regulator, a pressure reducer or another downstream air distributor.

Figure 4C:
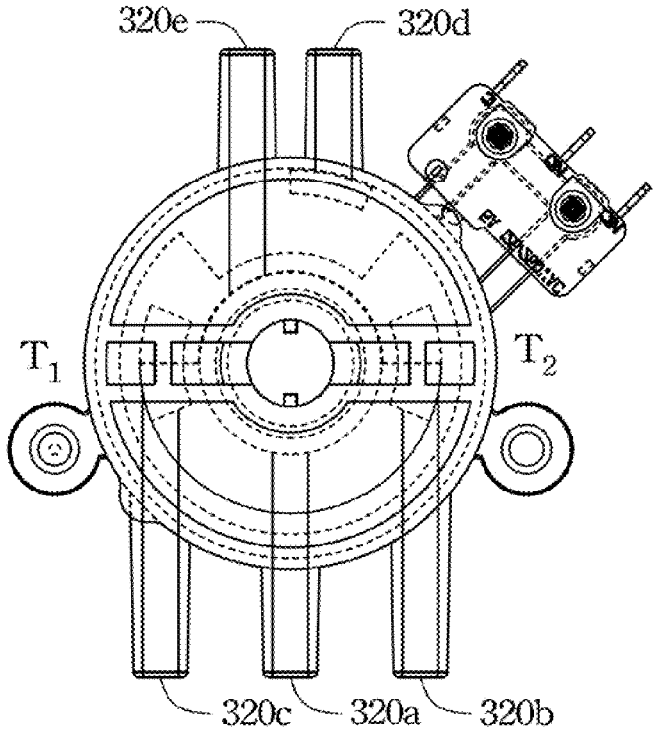

In FIG. 4C, the disc-shaped half 302*a* is at the position with $T_2$ at a right-hand side and $T_1$ at a left-hand side. In this operation mode, an inlet 320*a* and three outlets (320*b*, 320*c*, 320*e*) are gas-interconnected to one another. That is, the pressurized air can be input through an inlet 320*a* and output through outlets (320*b*, 320*c*, 320*e*). The outlet 320*e* is connected to a regulator, a pressure reducer or another downstream air distributor. In this operation mode, an outlet 320*d*, which is to vent air out, is not gas-interconnected to the inlet 320*a* or three outlets (320*b*, 320*c*, 320*e*). The operation mechanism in FIG. 4C is the same as that in FIG. 4A.

Figure 4D:
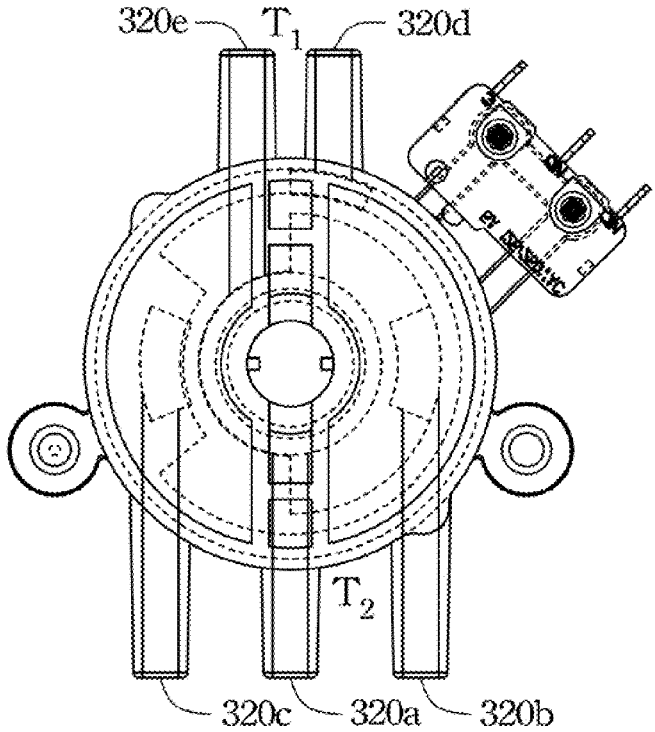

In FIG. 4D, the disc-shaped half 302*a* is at the position with $T_2$ at a lower side and $T_1$ at an upper side. In this operation mode, an inlet 320*a* and two outlets (320*b*, 320*e*) are gas-interconnected to one another whereas the two outlets (320*c*, 320*d*) are gas-interconnected to each other. That is, the pressurized air can be input through an inlet 320*a* and output through outlets (320*b*, 320*e*). The outlet 320*e* is connected to a regulator, a pressure reducer or another downstream air distributor.

Figure 5:
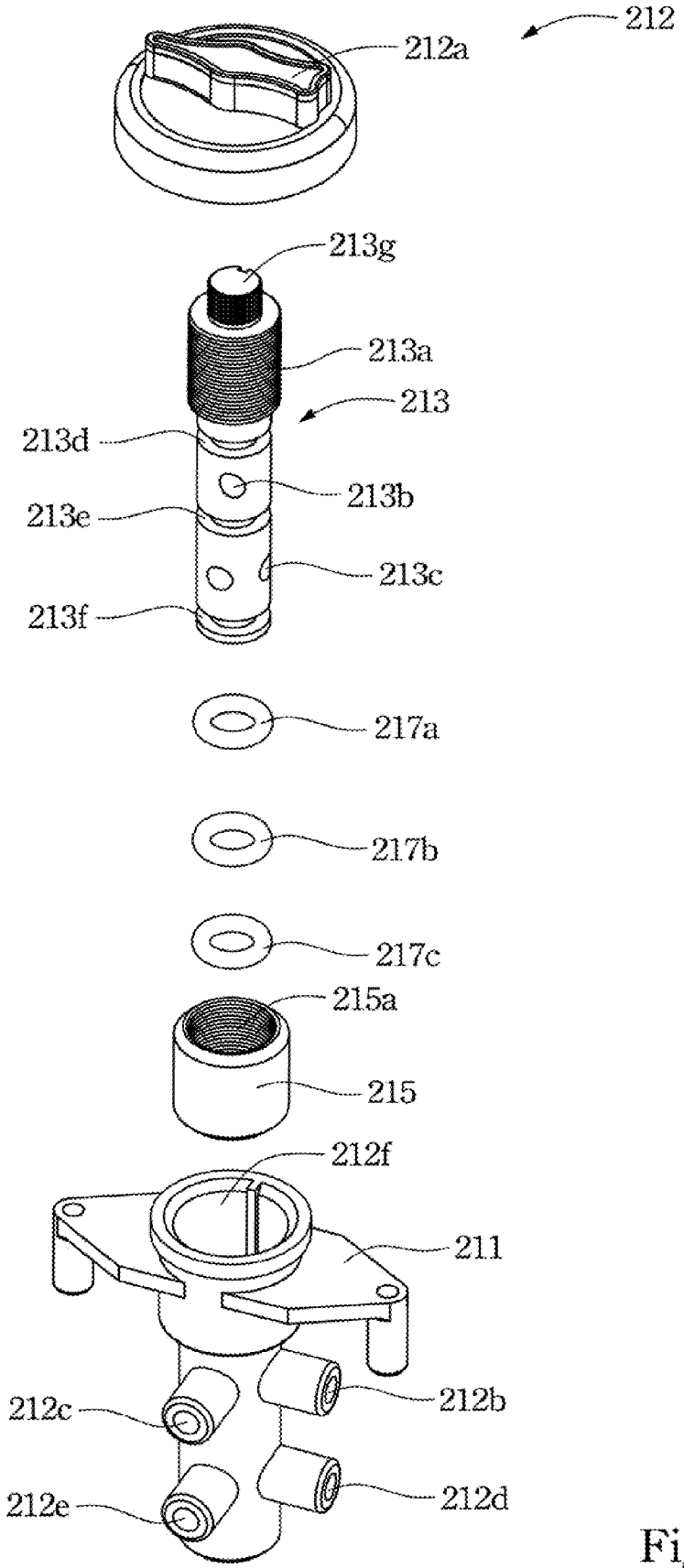
FIG. 5 illustrates an exploded view of a pressure reducer in FIG. 2.

FIG. 5 illustrates an exploded view of a pressure reducer in FIG. 2. The pressure reducer 212 basically consists of a hollow cylinder 211, a cylinder core 213 and a knob 212*a*. A connection member 215 (a hollow cylinder) is used to rotatably connect the cylinder core 213 within the hollow cylinder 211. The connection member 215 is firmly fitted within an inner surface 212*f* of the hollow cylinder 211. The cylinder core 213 has its threaded portion 213*a* loosely meshed with a thread inner surface 215*a* of the connection member 215 such that the cylinder core 213 is rotatable relative to the connection member 215 and the hollow cylinder 211. Besides the threaded portion 213*a*, a lower unthreaded portion of the cylinder core 213 is also loosely fitted within the inner surface 212*f* of the hollow cylinder 211, i.e. there is a gap between the inner surface 212*f* and the lower unthreaded portion of the cylinder core 213.

The cylinder core 213 has two air channels (213*b*, 213*c*) whereas the hollow cylinder 211 has two pair two pairs of inlets and outlets, i.e. inlet 212*c*, outlet 212*b*, inlet 212*e* and outlet 212*d*. Each channel penetrates through the cylinder core 213 and has two openings on an outer surface of the cylinder core 213. Each air channel (213*b*, 213*c*) is employed to interconnect between each pair of inlet and outlet such that the air can be transferred through thereof.

The knob 212*a* is secured to a top end 213*g* of the cylinder core 213 to be rotated by a user so as to enable the air channel

213*b* or air channel 213*c* to be interconnected between a corresponding pair of inlet and outlet.

Three O-rings (217*a*, 217*b*, 217*c*) are respectively fitted into three grooves (213*d*, 213*e*, 2130 of the cylinder core 213. The O-ring 217*b* is located between the air channel 213*b* and air channel 213*c*. The air channel 213*b* is located between the O-ring 217*a* and the O-ring 217*b* while the air channel 213*c* is located between the O-ring 217*b* and the O-ring 217*c* (when three O-rings are respectively fitted into three grooves). Each O-ring is to airtight seal the gap between the inner surface 212*f* and the lower unthreaded portion of the cylinder core 213.

Figure 5A:
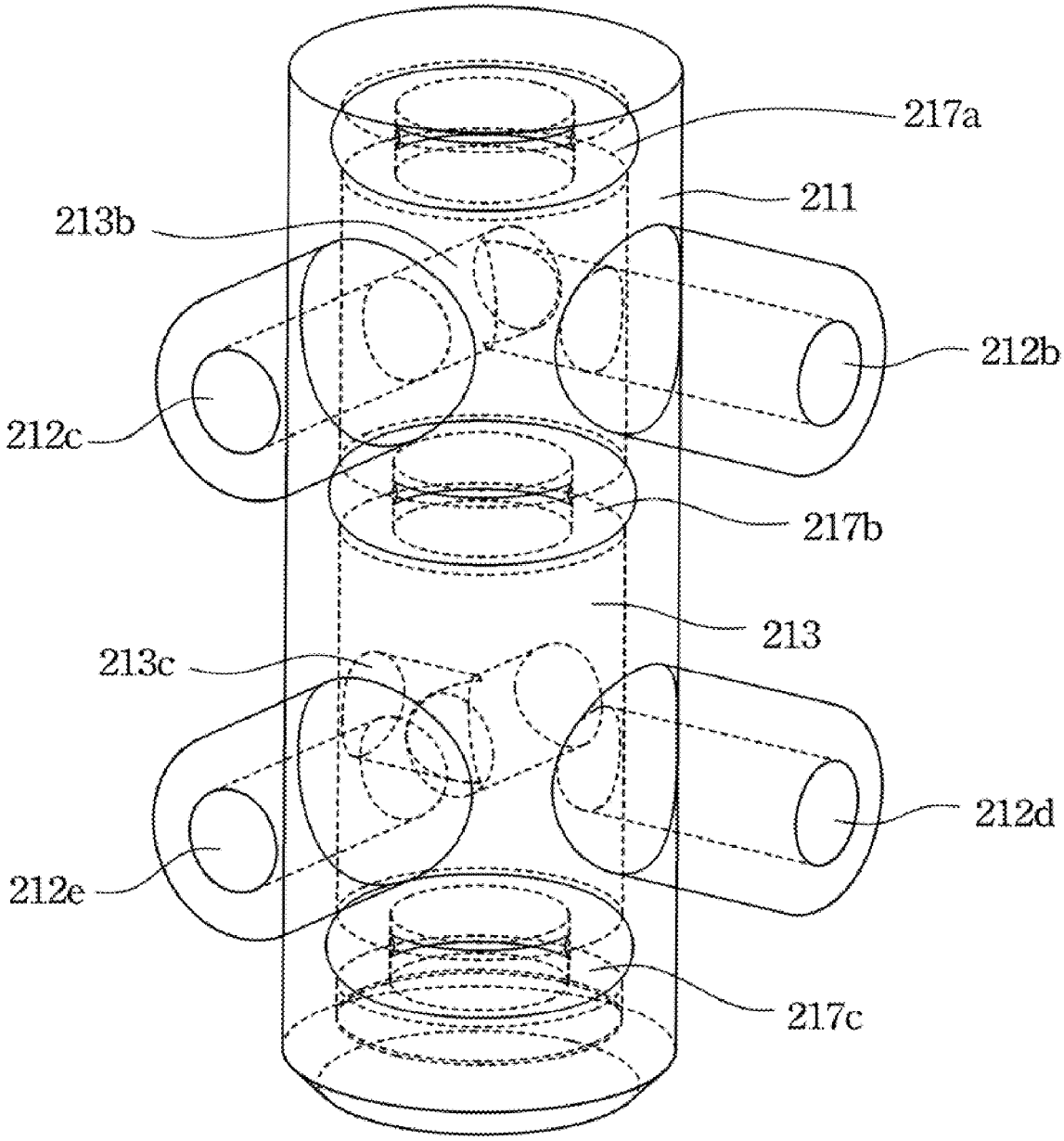
FIG. 5A and FIG. 5B respectively illustrate two operation modes of the pressure reducer in FIG. 5.
Figure 5B:
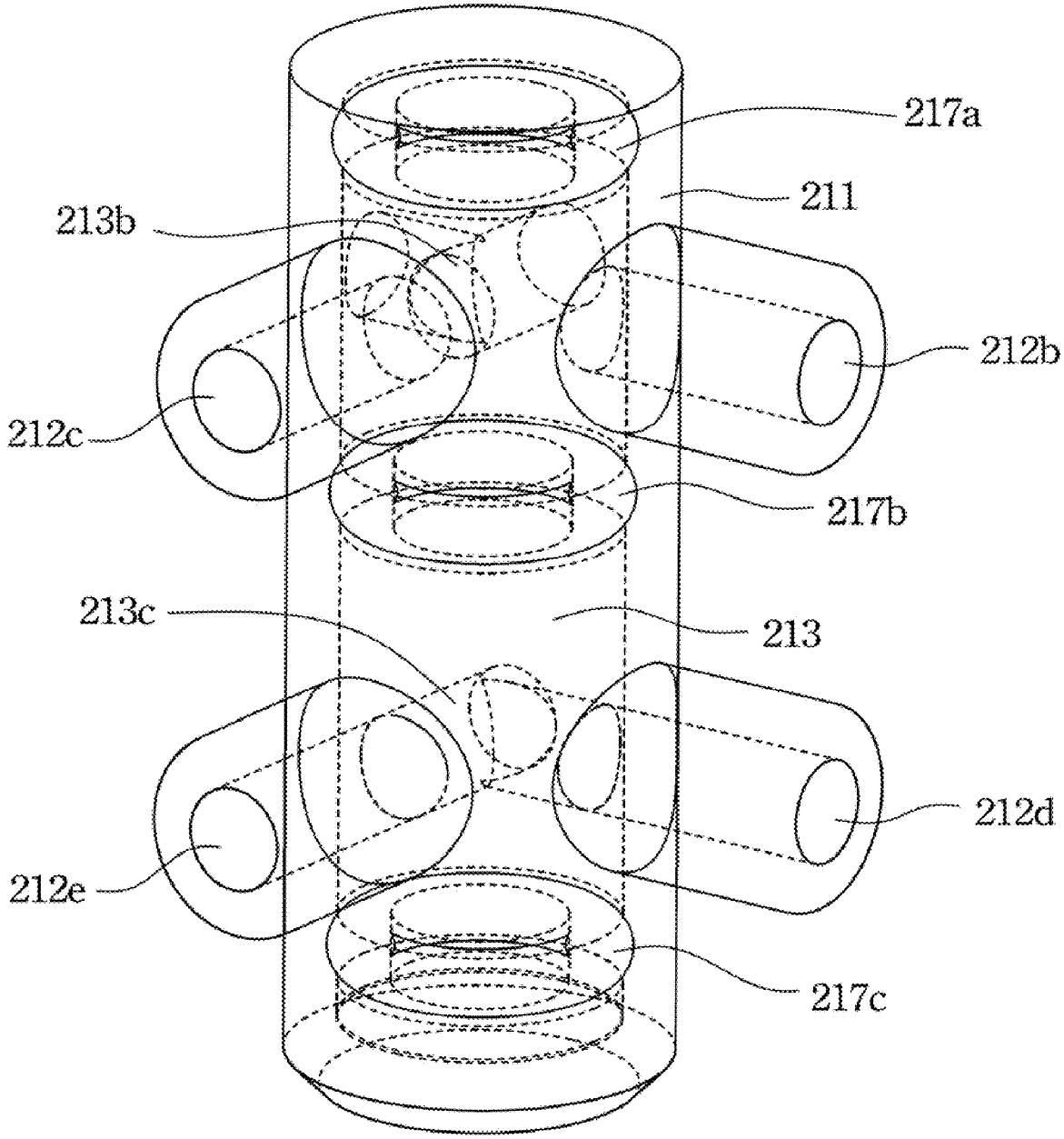

FIG. 5A and FIG. 5B respectively illustrate two operation modes of the pressure reducer in FIG. 5. These two Figures only illustrate the lower portion of the pressure reducer.

FIG. 5A illustrates a first position of the cylinder core 213 relative to the hollow cylinder 211 where the air channel 213*b* interconnects between the pair of inlet 212*c* in and outlet 212*b*, and the air channel 213*c* does not interconnect between the pair of inlet 212*e* and outlet 212*d*. Although the air channel 213*c* does not interconnect between the pair of inlet 212*e* and outlet 212*d*, the pair of inlet 212*e* and outlet 212*d* are stilled gas-connected, i.e. gas can be transferred through the gap between the cylinder core 213 and the hollow cylinder 211. That is, the airflow rate through the pair of inlet 212*c* and outlet 212*b* is greater than the airflow rate through the pair of inlet 212*e* and outlet 212*d* when the cylinder core 213 is at the first position relative to the hollow cylinder 211.

FIG. 5B illustrates a second position of the cylinder core 213 relative to the hollow cylinder 211 where the air channel 213*c* interconnects between the pair of inlet 212*e* and outlet 212*d*, and the air channel 213*b* does not interconnect between the pair of inlet 212*c* and outlet 212*b*. Although the air channel 213*b* does not interconnect between the pair of inlet 212*c* and outlet 212*b*, the pair of inlet 212*c* and outlet 212*b* are stilled gas-connected through the gap between the cylinder core 213 and the hollow cylinder 211. That is, the airflow rate through the pair of inlet 212*e* and outlet 212*d* is greater than the airflow rate through the pair of inlet 212*c* and outlet 212*b* when the cylinder core 213 is at the second position relative to the hollow cylinder 211.

Referring to FIG. 2, FIG. 5A and FIG. 5B, when the pressure reducer 212 is used in the pump set in FIG. 2, the inlet 212*c* is connected to an upstream air distributor or regulator, the inlet 212*e* and outlet 212*b* are both connected to the inlet 214*a* of the downstream air distributor 214, and the outlet 212*d* is to vent air out.

When a user rotates the knob 212*a* to switch the cylinder core 213 at the first position relative to the hollow cylinder 211 (where the air channel 213*b* interconnects between the pair of inlet 212*c* and outlet 212*b*), the pressurized air through the pair of inlet 212*c* and outlet 212*b* will be transferred to the downstream air distributor 214 in larger part and transferred through the pair of inlet 212*e* and outlet 212*d* in smaller part. Therefore, the pressure of the pressurized air is dropped down by the pressure reducer 212.

When a user rotates the knob 212*a* to switch the cylinder core 213 at the second position relative to the hollow cylinder 211 (where the air channel 213*c* interconnects between the pair of inlet 212*e* and outlet 212*d*), the airflow rate through the pair of inlet 212*c* and outlet 212*b* is smaller than the airflow rate through the pair of inlet 212*e* and outlet 212*d*. In this case, the downstream airflow is flowed back through the pair of inlet 212*e* and outlet 212*d* while the pressurized air is still transferred through the pair of inlet 212*c* and outlet 212*b*. Therefore, in this case (the cylinder core 213 at the second position relative to the hollow cylinder 211), the pressure of the pressurized air is dropped even down by the pressure reducer 212 compared with the case where the cylinder core 213 is at the first position relative to the hollow cylinder 211.

According to the discussed embodiments herein, the air pump is serially connected with several air pressure control devices to control multiple zones of an air mattress so as to reduce needed air pressure control devices. Besides, two air distributors are combined and driven by a single motor such that less motors and controllers are needed to operate the air mattress.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An air mattress comprising:

at least two separate zones;

a first and second groups of elongate, inflatable cells disposed alternately within each of the at least two separate zones;

an air pump for supplying pressurized air;

at least two air distributors serially connected with the air pump for respectively distributing the pressurized air to the at least two separate zones, each air distributor being operable to supply the pressurized air to the first and second groups of cells within each of the at least two separate zones; and a pressure reducer serially connected between any adjacent two of the at least two distributors for reducing the pressure of the pressurized air to a downstream one of any adjacent two of the at least two distributors.

2. The air mattress of claim 1, wherein the first and second groups of cells are disposed adjacent to each other and generally in parallel with each other.

3. The air mattress of claim 1, further comprising a regulator serially connected between the pressure reducer and an upstream one of any adjacent two of the at least two distributors.

4. The air mattress of claim 3, wherein an upstream one of the at least two distributors comprises an air inlet and three air outlets, the air inlet is connected to the air pump, two of the three air outlets are respectively connected to the first and second groups of cells, the remaining air outlet is connected to the regulator.

5. The air mattress of claim 1, wherein an upstream one of the at least two distributors comprises an air inlet and three air outlets, the air inlet is connected to the air pump, two of the three air outlets are respectively connected to the first and second groups of cells, the remaining air outlet is connected to the pressure reducer.

6. The air mattress of claim 1, wherein each of the at least two distributors comprises two disc-shaped halves rotatably interconnected with each other.

7. The air mattress of claim 1, wherein any adjacent two of the at least two distributors are interconnected with each other.

8. The air mattress of claim 7, further comprising a motor having a rotatable shaft to connect any adjacent two of the at least two distributors.

9. The air mattress of claim 8, wherein each of the at least two distributors comprises a static disc-shaped half and a rotatable disc-shaped half rotatably interconnected with each other, the rotatable disc-shaped half is secured to the rotatable shaft.

10. The air mattress of claim 9, further comprising a compression spring disposed around the rotatable shaft and between the motor and the rotatable disc-shaped half.

11. The air mattress of claim 1, wherein the pressure reducer comprises:

a hollow cylinder comprising a first pair of inlet and outlet and a second pair of inlet and outlet; and a cylinder core being loosely fitted within the hollow cylinder, and comprising a first air channel and a second air channel, wherein the cylinder core is rotatable between a first position and a second position relative to the hollow cylinder, when the cylinder core is at the first position relative to the hollow cylinder, the first air channel interconnects between the first pair of inlet and outlet, and the second air channel does not interconnect between the second pair of inlet and outlet, when the cylinder core is at the second position relative to the hollow cylinder, the second air channel interconnects between the second pair of inlet and outlet, and the first air channel does not interconnect between the first pair of inlet and outlet.

12. The air mattress of claim 11, further comprising a knob secured to the cylinder core and sticking out of the hollow cylinder.

13. The air mattress of claim 11, wherein the pressure reducer further comprises:

a first O-ring disposed between the hollow cylinder and the cylinder core, and between the first and second air channels.

14. The air mattress of claim 13, wherein the pressure reducer further comprises:

a second O-ring and a third O-ring both disposed between the hollow cylinder and the cylinder core, wherein the first air channel is disposed between the first O-ring and the second O-ring, wherein the second air channel is disposed between the first O-ring and the third O-ring.

15. The air mattress of claim 14, wherein the cylinder core comprises three grooves to be respectively fitted by the first, second and third O-rings.

16. The air mattress of claim 11, further comprising a connection member firmly fitted within part of the hollow cylinder and has a threaded inner surface.

17. The air mattress of claim 16, wherein the cylinder core comprises a threaded portion to be loosely meshed with the threaded inner surface of the connection member.

* * * * *